US007402233B1

(12) United States Patent
Morgan

(10) Patent No.: US 7,402,233 B1
(45) Date of Patent: Jul. 22, 2008

(54) APPARATUS AND METHOD FOR CATHODICALLY PROTECTING METALS AGAINST CORROSION

(76) Inventor: Glen E. Morgan, Rt. 2, Box 255A-1, Meeker, OK (US) 74844

( * ) Notice: Subject to any disclaimer, the term of this patent is extended or adjusted under 35 U.S.C. 154(b) by 353 days.

(21) Appl. No.: 11/273,115

(22) Filed: Nov. 14, 2005

Related U.S. Application Data

(63) Continuation-in-part of application No. 10/124,056, filed on Apr. 17, 2002, now abandoned.

(51) Int. Cl.
*C23F 13/10* (2006.01)

(52) U.S. Cl. ..... 205/730; 205/732; 205/733; 205/740; 204/196.22; 204/196.23; 204/196.24; 204/196.25; 204/196.37

(58) Field of Classification Search ..... 205/730, 205/732, 733, 740; 204/196.22, 196.23, 204/196.24, 196.25, 196.3, 196.37
See application file for complete search history.

(56) References Cited

U.S. PATENT DOCUMENTS 2,766,200 A 10/1956 Kaufman
2,863,819 A 12/1958 Preiser
3,011,959 A 12/1961 Anderson
3,513,082 A 5/1970 Beer et al.
3,893,903 A 7/1975 Lindholm
3,994,794 A 11/1976 Bohne
4,496,444 A * 1/1985 Bagnulo ..... 205/731
4,915,808 A 4/1990 McCready et al.
5,525,208 A 6/1996 Pritula et al.
5,728,275 A 3/1998 Twigg

* cited by examiner

*Primary Examiner*—Bruce F Bell
(74) *Attorney, Agent, or Firm*—James F. Harvey, III; Doerner Saunders Daniel & Anderson, LLP

(57) ABSTRACT

A cathodic protection system is provided for cathodically protecting an metallic substrate against corrosion, where the system comprises a sacrificial anodic material containing, but not limited to, zinc, magnesium, aluminum or a mixture of these materials, with a ceramic magnet, coupled with a plug, embedded into the sacrificial anode in such a way as to take advantage of the magnetic flux for transfer of electrons from the sacrificial anode to the object being protected, the unit is affixed to the object being protected by use of an electrically-conductive adhesive. The electrical connection may be established via the combination of the ceramic magnet and the electrically-conductive adhesive. The magnet may be magnetized in the direction of its thickness.

19 Claims, 3 Drawing Sheets

APPARATUS AND METHOD FOR CATHODICALLY PROTECTING METALS AGAINST CORROSION

CROSS-REFERENCES TO RELATED APPLICATIONS

This patent application is a continuation-in-part of U.S. patent application Ser. No. 10/124,056, filed by the same inventor Apr. 17, 2002, and entitled "Body" now abandoned.

BACKGROUND OF THE INVENTION

The present invention relates to an electrode system and method for cathodically protecting metal objects against corrosion. More particularly, this invention relates to electrodes of zinc, aluminum, magnesium, platinum, platinum-coated titanium, which are magnetically and electrically secured to ferro-magnetic metals, such as steel, steel compounds, nickel, cobalt for cathodically protecting these metals against corrosion.

Sacrificial anodes are used in various metal structures, for example, hot water heater tanks, water tanks, and ship's hulls, in order to prevent corrosion of the metal structure. Metal surfaces, particularly those of ferrous materials, when exposed to air and water, undergo oxidation or corrosion. While metal surfaces may be coated (for example, with zinc) or lined (for example, lining the interior of a hot water tank with glass), such coatings and linings are subject to imperfections or breakage and are frequently expensive. As such, many manufacturers use sacrificial anodes of a galvanically active metal, such as zinc, aluminum or magnesium, instead of such coatings and linings, or in addition to them as extra protection against corrosion. In such cathodic protection systems, the anode is both physically and electrically attached to the surface. The anode becomes depleted during its operational life to provide cathodic protection to the surrounding metal structure (i.e., the inside of the tank or the hull of a ship) and must eventually be replaced.

The cathodic protection of ferro-magnetic metals by means of electrodes is well known in the prior art. For example, U.S. Pat. No. 3,513,082, issued to Beer et al., discloses an anode attached to a magnet, which in turn is attached by magnetic action to the surface to be protected. The magnetic provides the physical attachment of the device to the surface as well as electrical conductivity between the anode and the surface.

There are a number of advantages to this attachment method. By securing the sacrificial anode to the object by means of a metal magnet, the replacement and/or renewal of the sacrificial anode and of the metal magnet is a simple operation. Furthermore, it is not necessary to provide special fastening means for the magnet since the magnet itself provides secure contact. Attachment of sacrificial anodes by use of magnetism may be convenient various small vehicles, tools, and other items of normal, everyday use.

However, such an arrangement has a number of problems. First, corrosion may develop between the surface of the magnet and the surface to be protected, i.e. at the interface. Such corrosion results in pitting of the surface to be protected. The electric conduction at the interface becomes inadequate and the attraction of the metal magnet relative to the surface may be considerably reduced. Although the sacrificial anode will continue supply protection, this sacrificial anode cannot sufficiently exert its influence in the area between the magnet and the surface to be protected. This corrosion may after some time be such that pit-corrosion occurs in one of the two interface surfaces, the pits becoming oxidized, so that the electric conduction becomes insufficient and the magnetic attraction is reduced. As a consequence, the object becomes "under-protected" and further corrosion occurs, which may grow to such an extent that the sacrificial anode and the metal magnet comes off the object and cathodic protection stops entirely.

As can be seen, there is a need for an improved sacrificial anode in a cathodic protection system, which does not exhibit undue corrosion at the interface between the sacrificial anode and the object to be protected. The cathodic protection system should have a better attachment method for connecting the sacrificial anode to the metal surface of the object, and it should be of a size that may be easily and commercially used for everyday objects used by a typical consumer, such objects being, for example, tractors, automobiles, tools, and the like.

SUMMARY OF THE INVENTION

The invention provides a passive cathodic protection system for a metallic substrate, where the system comprises a sacrificial anode with a top surface and a bottom surface, the sacrificial anode having a cavity within the interior of the sacrificial anode for placement of a magnet. In some embodiments, the cavity may be a recess with a floor, the recess extending from the top surface through the sacrificial anode in a direction of the bottom surface; a magnet with an upper surface and a lower surface, the magnet inserted within the recess so that the lower surface abuts the floor of the recess; and a plug sealing the magnet within the recess, the plug abutting the upper surface of the magnet; so that the sacrificial anode is attached to the metallic substrate by an electrically-conductive adhesive.

The invention also provide a sacrificial anode for cathodic protection of a metallic substrate having a first interface surface, the sacrificial anode having a second interface surface. The sacrificial anode may comprise an anode composed of a metallic material selected from a group consisting of zinc, platinum, iron, aluminum, and alloys thereof, the anode surrounding a magnet, the magnetic having a first pole in electrical communication with the first second interface surface and a second pole in electrical communication with an opposing surface of the anode, the magnet disposed to increase magnetic flux flowing through the anode; and an electrically-conductive adhesive forming a seal between the first interface surface and the second interface surface, so that environmental substances are prevented from coming into contact with the interface surfaces, the adhesive allowing an electron flow from the metallic substrate to the anode across the interface, wherein the magnetic flux of the magnet is arranged to promote the electron flow. The magnet may removably attach the sacrificial anode to the metallic substrate for easy replacement.

A method for cathodically protecting a metallic substrate against corrosion is also provide. The method comprises the steps of (1) providing sacrificial anode having a magnet embedded therein, the sacrificial anode having a reduction potential that is less in magnitude than a reduction potential of the metallic substrate, the sacrificial anode having a first interface surface for contact with the metallic substrate, wherein a first pole of the magnet is in communication with a top surface of the sacrificial anode and a second pole of the magnet is in communication with the first interface surface; (2) selecting a second interface surface on the metallic substrate; (3) applying an electrically-conductive adhesive to the first interface surface and second interface surface; and (4) attaching the sacrificial anode to the metallic substrate by means of an electrically-conductive adhesive, wherein a seal is formed between the first interface surface and the second interface surface to prevent environmental substances from coming in contact with the interface surfaces.

These and other features, aspects and advantages of the present invention will become better understood with reference to the following drawings, description and claims.

DETAILED DESCRIPTION OF THE INVENTION

Figure 1:
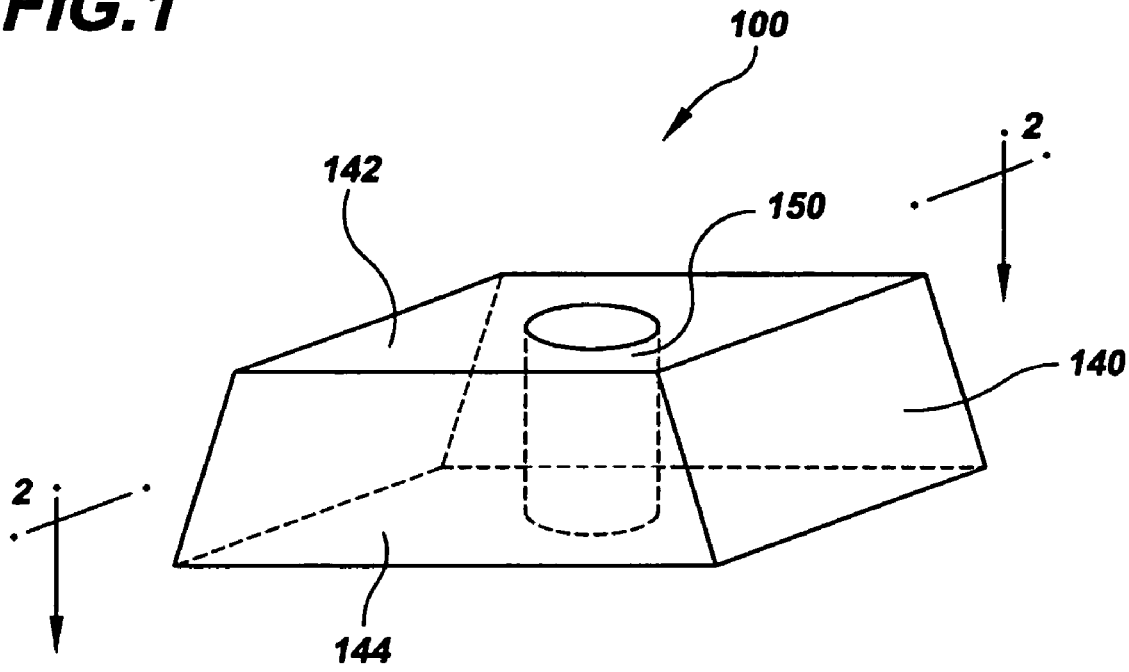
FIG. 1 shows a perspective view of a cathodic protection system, according to an embodiment of the invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

According to the invention, a cathodic protection system may be provided for protection of a metallic substrate, where the cathodic protection system may comprises a sacrificial anode, an electrically-conductive adhesive for adhering the anode to the substrate, and a magnet. The sacrificial anode and the metallic substrate to be protected may be attached by means of electrically conductive adhesive having sufficient strength to hold the sacrificial anode to the surface of an object to be protected without additional aid of the magnet. Such an adhesive may be a silicon based adhesive containing one or more electrically-conductive materials, such as nickel, graphite, and carbon fibers. The use of an electrically-conductive adhesive may protect the surfaces between the portions of the sacrificial anode and of the metallic substrate, which jointly comprise the interface, so that they are not rendered ineffective by the current passing through therethrough or by electrochemical reactions that may take place at one or both of these surfaces.

The sacrificial anode may be comprised of a zinc-containing alloy base having a magnet embedded therein. The sacrificial anode may be attached by the electrically-conductive adhesive to the surface of a metallic substrate, which may be any object (e.g. an automobile) that is to be protected from corrosion.

The scientific basis for such corrosion protection is well established. When two dissimilar metals are placed in contact with each other, a galvanic cell is created, in which the metal with the lower reduction potential ($E^{\circ}$) becomes the anode and the other material becomes the cathode. Where an iron-based object is to be protected, a sacrificial anode comprised of zinc, having $E^{\circ}=-0.76V$, may be used, since iron with $E^{\circ}=-0.44V$ would become the cathode. An electromotive force of 0.33V would result at the interface of this cathode and anode under standard conditions, but this has been proven in practice to be sufficient for acceptable corrosion protection. The surfaces that are in contact should exhibit little or no resistance to the flow of electronic therebetween.

The prevention of corrosion stems from the fact that the rusting process is an oxidation reaction in which oxygen gas accepts electrons from the metal to form an oxide. In a galvanic cell, the anode has the surplus of electrons rather than the cathode, and therefore corrosion will occur at the anode, resulting in the production of zinc oxide at the anode and thus retarding the rusting of the metal part to which it is attached. However, zinc oxide is not a good conductor. In order to prevent zinc oxide from developing along the interface between the sacrificial anode and the metal surface where it would inhibit the flow of electrons, an electrically-conductive adhesive may be used according to the invention to seal this interface away from moisture and other elements that would promote corrosion along the interface which would otherwise resist the electron flow through the interface. It has been found that the presence of a magnet within the sacrificial anode will advantageously promote the electron flow therebetween. The magnetic lines of flux may assist electron flow by attracting the negatively charged electrons when the magnet is oriented properly to the surface. The magnet may advantageously be placed within a cavity within the anode; for ease in construction, the cavity may be provided as a recess extending from one surface of the sacrificial anode through the anode to an opposing surface.

Figure 2:
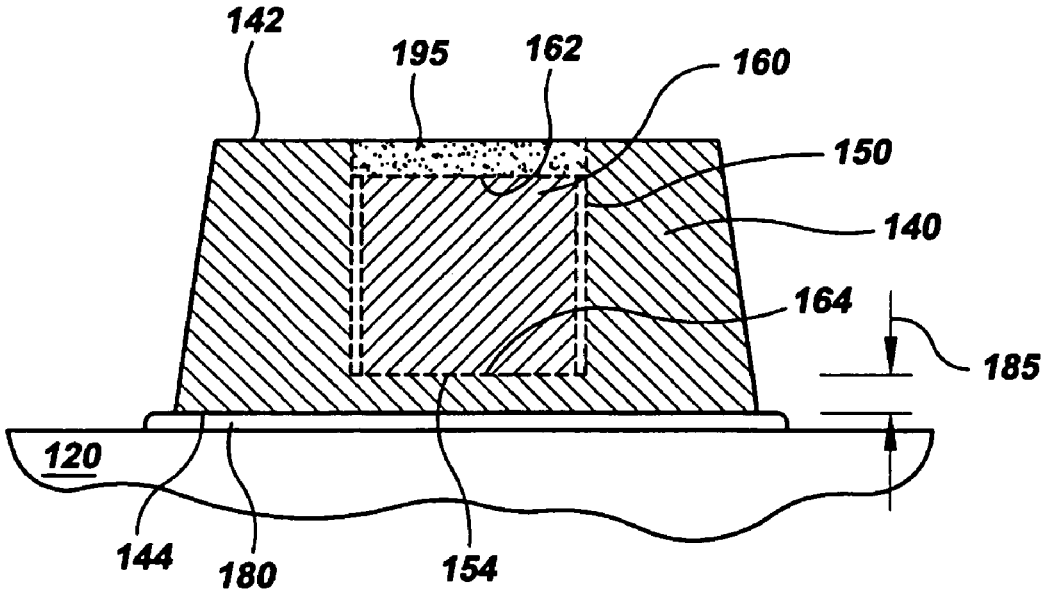
FIG. 2 shows a cross sectional view of a cathodic protection system to illustrate its internal construction, according to an embodiment of the invention.

Referring now to FIGS. 1 and 2, an embodiment of a cathodic protection system 100 is provided by the invention for a metallic substrate 120 that is to be protected against corrosion. The invention may comprise a sacrificial anode 140, a magnet 160, and an electrically-conductive adhesive 180. As can be seen from FIG. 1, the embodiment of the cathodic protection system 100 as shown may be shaped as a truncated pyramid having a rectangular base, in order to facilitate casting of the anode and subsequent removal from a mold, but other shapes may be used without departing from the scope of the invention.

The sacrificial anode 140 may be composed of an anodic material, such as zinc, magnesium, aluminum, or combinations thereof. A typical composition of a sacrificial anode 140 may be zinc or a zinc alloy, although other compositions may be used with relation to different surfaces, without departing from the scope of the invention.

The cathodic protection system 100 may have a cavity to provide a seat for a magnet. The sacrificial anode may be fabricated around the magnet so that the magnet forms a cavity with in the sacrificial anode. In one embodiment, the cavity may be in the form of a recess 150 imposed from without the sacrificial anode 140 and extending into the sacrificial anode 140 from a top side 142 in a direction towards a bottom side 144, so that the recess 150 may be in communication with the top side 142 and not with the bottom side 144. The recess 150 may extend through the sacrificial anode 140 so that a distance 185 may separate the bottom side 144 from the recess 150. The bottom side 144 of the sacrificial anode 140 may serve as the interface between the metallic substrate 120 and the cathodic protection system 100. Along the interface, an electrically-conductive adhesive 180 may be applied to electrically complete a circuit between the cathodic protection system 100 and the metallic substrate 120 and to seal the surface areas between the bottom side 144 and an identically shaped portion of the surface of the metallic substrate 120.

A magnet 160 may be captured and held within recess 150 by a plug 195. The magnet 150 may be shaped as a cylinder or disc, with the disc being magnetized in the direction of its thickness, so that the poles of the magnet being at the top and bottom ends of the magnet. Other shapes may be used for the magnet 160 without departing from the scope of the invention, but the lines of magnetic force of the magnet 160 must be oriented so that a magnetic flux is established that is perpendicular to the interface. The magnet 150 may typically be of ceramic construction, since such magnets are easily and cheaply manufactured, but other magnetic materials and shapes may be used without departing from the scope of the invention. Although the electrically-conductive adhesive 180 may be sufficient to attach the magnet 160 to the metallic substrate 120, the magnet 160 may also assist attachment of the cathodic protection system 100 to the metallic substrate 120 in some uses.

In an alternative embodiment (not shown) of the invention, the recess 150 may extend into the sacrificial anode 140 from the bottom side 144 in a direction towards the top side 142, so that the recess 150 may be in communication with the bottom side 144 and not with the top side 142. In this embodiment, a magnet 160 may be captured and held within recess 150 by a plug 195 inserted from the bottom side 144.

The magnet 160 and plug 195 may be sized so that, when the lower surface 164 of the magnet 160 abuts a floor 154 of the recess 150, the plug 195 may be snugly inserted into the recess 150 to abut an upper surface 162 of the magnet 160, so that the plug 195 may be flush with the top side 142 of the sacrificial anode 140.

The electrically-conductive adhesive 180 may serve to seal the interface between the cathodic protection system 100 and the metallic substrate 120 to be protected. By sealing the interface from outside contaminants, such as moisture, corrosion at the interface may be inhibited so that such corrosion will occur along the other surfaces of the sacrificial anode 140. The adhesive may be comprised of any suitable adhesive to which has been added various electrically-conductive materials, such as graphic, iron filings, nickel graphite compositions, and the like. Such electrically conductive materials prevent the adhesive from becoming an insulator and thus inhibiting the free flow of electrons from the cathode (i.e. metal surface) to the sacrificial anode 140. A typical adhesive may be a silicone-based adhesive containing a nickel graphite composition, although other such compositions may be used without departing from the scope of the invention.

Figure 3A:
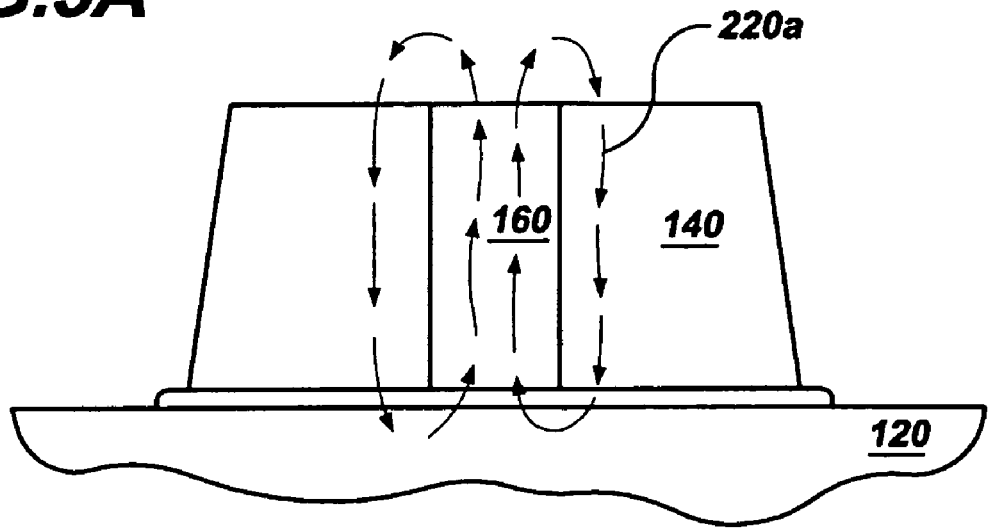
FIG. 3A shows the magnetic field of an embodiment of the invention without a plug or a floor to a recess within the sacrificial anode.
Figure 3B:
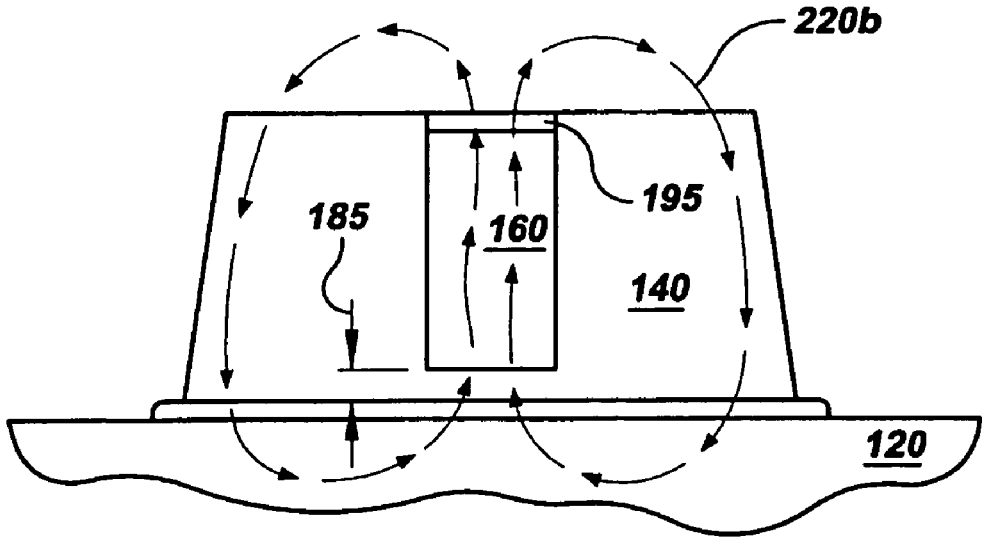
FIG. 3B shows the enhancement of the magnetic field for an embodiment of the invention having a plug and a floor to the recess.

It has been advantageously found through experimentation that, for the present invention, the primary function of the magnet 160 may be to increase the flow of electrons across the interface. The flux of the magnet 160, in effect, acts as a booster to increase the corrosion protection effect over use of a sacrificial anode 140 without such a magnet 160. Referring now to FIGS. 3A and 3B, it has been further found that contact between one pole of the magnet 160 with the plug 195 and contact between the other pole of the magnet 160 and the floor 154 of recess 150 further enhances the magnetic field. FIG. 3A may illustrate the magnet 160 with no contact between its poles and the sacrificial anode 140. In this case, the magnetic field 220*a* may be observed to be strongest at the poles of the magnet 160 and then to rapidly become less dense along the top and bottom sides 142, 144 of the sacrificial anode 140. However, in FIG. 3B, the plug 195 may extend the top pole of the magnet 160 across the top side 142 by making abutting contact with the magnet 160 and providing continuity between it and the top side 142. Similarly, the floor 154 of the recess may be in abutting contact with the other pole of the magnet 160, so that the magnetic field 200*b* may be extended along the bottom side 144 of the sacrificial anode 140. It has been observed that contact between the magnet 160 and either the floor 154 or the plug 195 may provide better corrosion protection effect than the arrangement in FIG. 3A, and contact between a pole and the floor 154 and between the opposing pole and the plug 195 may provide even better corrosion protection effect than the use of a single contact point.

As an example of how the invention may be fabricated for use in commerce, a block of zinc alloy having a weight of about 1.5 lbs and having a bottom side measuring about 2 in. by 2 in. was fabricated in the shape shown in FIG. 1. A recess was drilled therein so that the floor 154 was a distance 185 of ⅛ in. to ¼ in. of the bottom surface 144. With the plug 195 inserted into the recess, a magnetic field 220*b* was measured to extend about a 1½ in. to 2 in. circle along the bottom surface 144 of the cathodic protection system.

Figure 4:
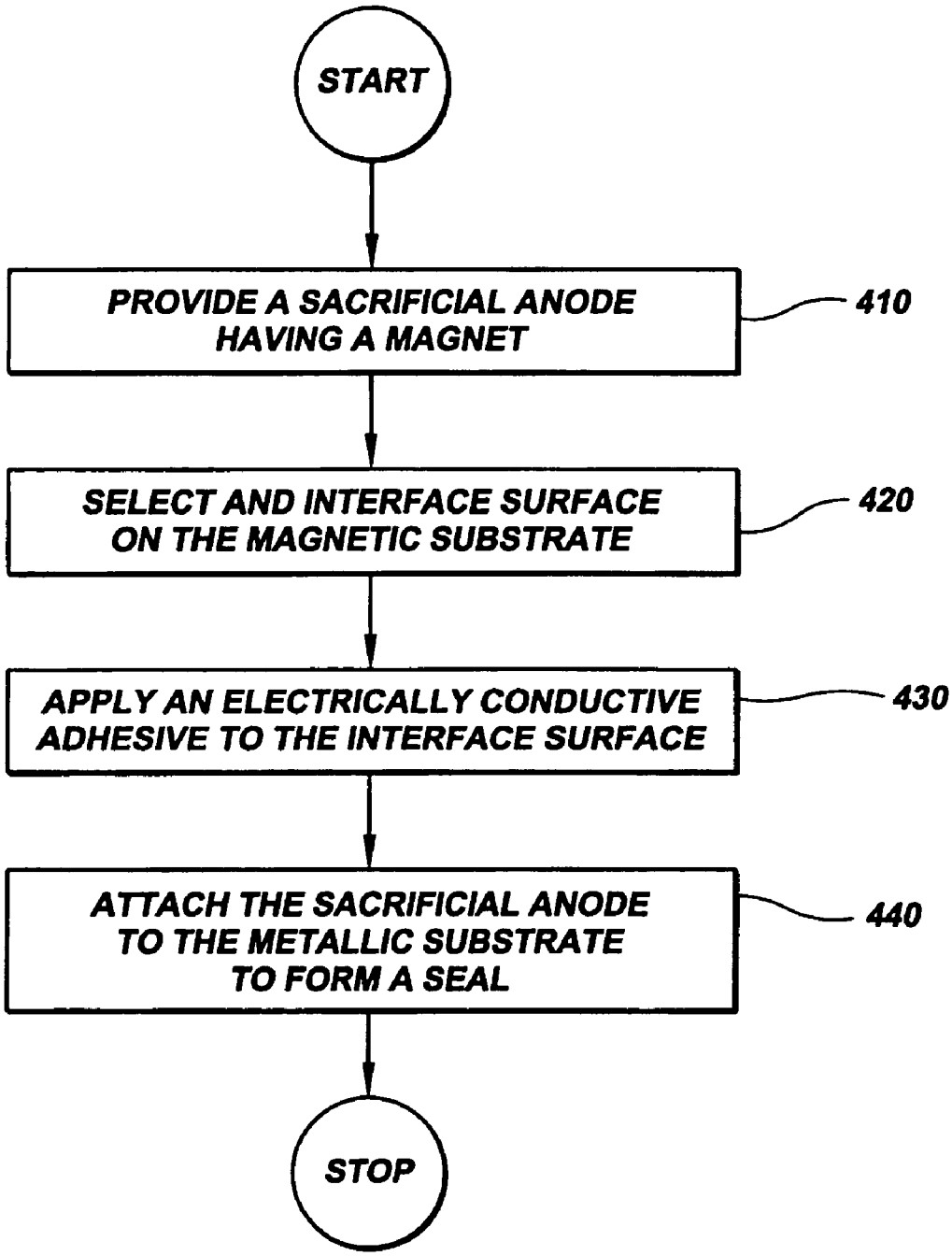
FIG. 4 shows a flowchart of a method for practicing the invention, according to embodiments of the invention.

The invention may also provide a method for cathodically protecting a metallic substrate against corrosion, according to FIG. 4. A sacrificial anode may be provided, which has a magnet embedded therein and which has an interface surface, according to the block labeled 410. The material comprising the sacrificial anode may be chosen so that the reduction potential of the sacrificial anode is less in magnitude than the reduction potential of the metallic substrate to be protected. A second interface surface on the metallic substrate may be selected for attachment of the sacrificial anode, according to the block labeled 420. An electrically-conductive adhesive may be applied to the interface surface of the sacrificial anode and the selected interface surface on the magnetic substrate, according to the block labeled 430. Finally, the sacrificial anode may be attached to the selected interface surface of the metallic substrate by means of the electrically-conductive adhesive, according to the block labeled 440. Sufficient pressure may be applied to remove bubbles therebetween, to make the film of electrically-conductive adhesive as thin as possible, and to ensure that a seal is formed between the interface surface of the sacrificial anode and the interface surface of the metallic substrate to prevent environmental substances from coming in contact with the interface surfaces.

From the foregoing, it will be understood by persons skilled in the art that an innovative cathodic protection system has been provided. The invention is relatively simple and easy to manufacture, yet affords a variety of applications. While the description contains many specifics, these should not be construed as limitations on the scope of the invention, but rather as an exemplification of the preferred embodiments thereof. The foregoing is considered as illustrative only of the principles of the invention. Further, because numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention as set forth in the following claims.

I claim:

1. A sacrificial anode having a bottom surface, a top surface opposing the bottom surface, and a cavity, the sacrificial anode attached to a metallic substrate by an electrically-conductive adhesive covering the bottom surface, wherein the bottom surface and a portion of the metallic substrate adjoining the bottom surface are sealed from contact with environmental substances, the sacrificial anode further having a magnet within the cavity, the magnet having an upper surface associated with a pole of the magnet and a lower surface associated with an opposing pole of the magnet, wherein the magnet is oriented with the lower surface towards the bottom surface and with the upper surface towards the top surface.

2. The sacrificial anode described in claim 1, wherein the cavity is a recess with a floor, the recess extending from the top surface through the sacrificial anode in a direction of the bottom surface.

3. The sacrificial anode described in claim 2, further comprising a plug sealing the magnet within the recess.

4. The sacrificial anode described in claim 3, wherein the plug abuts the upper surface of the magnet and the floor abuts the lower surface of the magnet.

5. The sacrificial anode described in claim 1, wherein the magnet is a ceramic magnet.

6. The sacrificial anode described in claim 1, wherein the electrically-conductive adhesive comprises an adhesive mixed with particles of a material selected from a group consisting of graphite, iron, carbon, and nickel.

7. The sacrificial anode described in claim 1, wherein the adhesive is a silicone-based adhesive.

8. The sacrificial anode described in claim 1, wherein the cavity is a recess with a floor, the recess extending from the bottom surface through the sacrificial anode in a direction of the top surface.

9. The sacrificial anode described in claim 8, further comprising a plug sealing the magnet within the recess.

10. A passive cathodic protection system for a metallic substrate, the system comprising:

a sacrificial anode having a top surface and a bottom surface, the sacrificial anode having a recess with a floor, the recess extending from the top surface through the sacrificial anode in a direction of the bottom surface;

a magnet having an upper surface and a lower surface, the magnet inserted within the recess so that the lower surface abuts the floor of the recess; and a plug sealing the magnet within the recess, the plug abutting the upper surface of the magnet;

wherein the sacrificial anode is attached to the metallic substrate by an electrically-conductive adhesive.

11. The passive cathodic protection system described in claim 10, wherein the magnet is a ceramic magnet.

12. The passive cathodic protection system described in claim 11, wherein the ceramic magnet is a disc that is magnetized in the direction of its thickness.

13. The passive cathodic protection system described in claim 10, wherein the sacrificial anode is comprised of a material selected from a group consisting of zinc, magnesium, iron, aluminum, platinum, and combinations of these materials.

14. The passive cathodic protection system described in claim 10, wherein the electrically-conductive adhesive comprises an adhesive mixed with particles of a material selected from a group consisting of graphite, iron, carbon, and nickel.

15. A method for cathodically protecting a metallic substrate against corrosion, the method comprising the steps of providing sacrificial anode having a magnet embedded therein, the sacrificial anode having a reduction potential that is less in magnitude than a reduction potential of the metallic substrate, the sacrificial anode having a first interface surface for contact with the metallic substrate, wherein a first pole of the magnet is in communication with a top surface of the sacrificial anode and a second pole of the magnet is in communication with the first interface surface;

selecting a second interface surface on the metallic substrate;

applying an electrically-conductive adhesive to the first interface surface and second interface surface; and attaching the sacrificial anode to the metallic substrate by means of an electrically-conductive adhesive, wherein a seal is formed between the first interface surface and the second interface surface to prevent environmental substances from coming in contact with the interface surfaces.

16. The method described in claim 15, wherein the poles of the magnet are in contact with the top surface and with the first interface surface.

17. The method described in claim 15, wherein the magnet is a ceramic magnet.

18. The method described in claim 15, further comprising the step of applying pressure to the sacrificial anode, wherein a seal is formed along the first interface surface and the second interface surface sufficient to prevent environmental substances from coming in contact with the interface surfaces.

19. A sacrificial anode for cathodic protection of a metallic substrate having a first interface surface, the sacrificial anode having a second interface surface, the sacrificial anode comprising an anode composed of a metallic material selected from a group consisting of zinc, platinum, iron, aluminum, and alloys thereof, the anode surrounding a magnet, the magnetic having a first pole in electrical communication with the first second interface surface and a second pole in electrical communication with an opposing surface of the anode, the magnet disposed to increase magnetic flux flowing through the anode; and an electrically-conductive adhesive forming a seal between the first interface surface and the second interface surface, wherein environmental substances are prevented from coming into contact with the interface surfaces, the adhesive allowing an electron flow from the metallic substrate to the anode across the interface, wherein the magnetic flux of the magnet is arranged to promote the electron flow;

wherein the magnet removably attaches the sacrificial anode to the metallic substrate.

* * * * *